US010455925B1

(12) United States Patent
Valdes

(10) Patent No.: US 10,455,925 B1
(45) Date of Patent: Oct. 29, 2019

(54) BACKPACK WITH INTEGRAL RAINCOAT

(71) Applicant: Jorge Valdes, Hialeah, FL (US)

(72) Inventor: Jorge Valdes, Hialeah, FL (US)

( * ) Notice: Subject to any disclaimer, the term of this patent is extended or adjusted under 35 U.S.C. 154(b) by 0 days.

(21) Appl. No.: 16/168,907

(22) Filed: Oct. 24, 2018

(51) Int. Cl.
*A45F 4/12* (2006.01)
*A45F 3/04* (2006.01)
*A41D 3/04* (2006.01)

(52) U.S. Cl.
CPC ..... *A45F 4/12* (2013.01); *A41D 3/04* (2013.01); *A45F 3/04* (2013.01); *A41D 2200/20* (2013.01)

(58) Field of Classification Search
CPC .... A45F 4/12; A45F 3/04; A41D 3/04; A41D 2200/20
USPC ..... 224/153; 2/93, 94
See application file for complete search history.

(56) References Cited

U.S. PATENT DOCUMENTS 4,792,040 A * 12/1988 Wagstaff, III ..... A41D 3/06 150/167
5,407,112 A * 4/1995 Christodoulou ..... A41D 15/04 2/94
5,562,236 A * 10/1996 Monzingo ..... A45C 7/0086 224/153
6,134,712 A * 10/2000 Spector ..... A41D 15/04 2/94
6,393,613 B1 * 5/2002 Sheu ..... A41D 15/04 2/94
2003/0033658 A1 * 2/2003 Hinnant ..... A41D 3/02 2/93
2003/0205593 A1 * 11/2003 Lavelle ..... A41D 3/08 224/153
2005/0056669 A1 * 3/2005 Lavelle ..... A41D 3/08 224/153
2005/0161483 A1 * 7/2005 Krohn ..... B62J 9/006 224/413
2015/0335081 A1 * 11/2015 Mangini ..... A41D 15/04 2/94
2016/0345711 A1 * 12/2016 Thibadeau ..... A45F 3/04
2017/0215558 A1 * 8/2017 Smith, Jr. ..... A41D 3/00
2019/0045854 A1 * 2/2019 Hartman ..... A41D 3/04

* cited by examiner

*Primary Examiner* — Corey N Skurdal
(74) *Attorney, Agent, or Firm* — Ruben Alcoba, Esq.

(57) ABSTRACT

A backpack that has an integral raincoat. The backpack comprises of a bag that has shoulder straps. The bag has a top, a bottom, a front and rear side, the shoulder straps are attached to the rear side. The rear side of the backpack defines a central opening that defines a first compartment that runs from a top rear side of the backpack toward a bottom rear side of the backpack. A retractable roller mechanism has a strap attached to the roller mechanism and the mechanism is attached to the first compartment of the backpack. A raincoat is permanently attached to the strap's end not attached to the roller mechanism. The bag defines at least one front compartment in the front of the bag.

3 Claims, 4 Drawing Sheets

BACKPACK WITH INTEGRAL RAINCOAT

CROSS REFERENCE

This application claims priority to and the benefit under 35 U.S.C. .sctn.119(e) of U.S. Provisional Patent Application No. 62/697,714, filed on Jul. 13, 2018, entitled "BACKPACK WITH INTEGRAL RAINCOAT," the entire disclosure of which is hereby incorporated herein by reference.

BACKGROUND

The present invention is directed to a backpack that has an integral raincoat.

The backpack has an integral raincoat attached to a part of the backpack that attaches to the body of a user.

The integral raincoat is designed to easily be deployed from the backpack and to be easily stowed in the backpack.

The backpack was designed to prevent a user from losing a raincoat after use and also to prevent the contents within a backpack to be wet when deploying the backpack during rain.

For the foregoing reasons, there is a need for a backpack that has an integral raincoat that will prevent the misplacement of the raincoat after its use and that will also prevent items within the backpack from getting wet from any precipitation when the raincoat is removed from the backpack.

SUMMARY

The present invention is a backpack that has an integral raincoat. The backpack comprises of a bag that has shoulder straps. The bag has a top, a bottom, a front and rear side, the shoulder straps are attached to the rear side. The rear side of the backpack defines a central opening that defines a first compartment that runs from a top rear side of the backpack toward a bottom rear side of the backpack. A retractable roller mechanism has a strap attached to the roller mechanism and the mechanism is attached to the first compartment of the backpack. A raincoat is permanently attached to the strap's end not attached to the roller mechanism. The bag defines at least one front compartment in the front of the bag.

An object of the present invention is to provide a backpack that has an attached retractable raincoat.

Another object of the present invention is to provide a backpack that can be deployed during precipitation that will prevent the contents within the backpack from getting wet.

DRAWINGS

These and other features, aspects, and advantages of the present invention will become better understood with regard to the following description, appended claims, and drawings where:

DESCRIPTION

Figure 1:
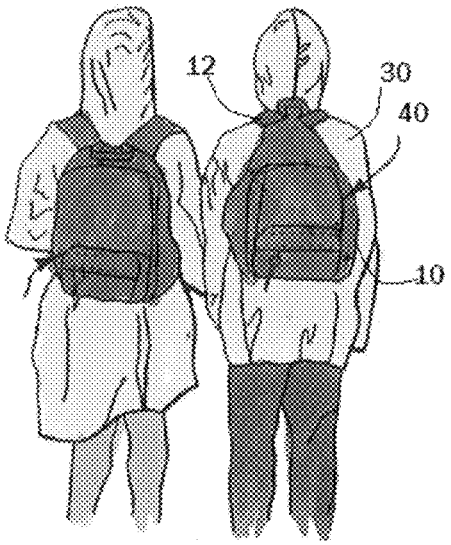
FIG. 1 is a depiction of the present invention on the back of the user, the depiction shows the front of the bag of the present invention, the bag on the shoulders of the user via its shoulder straps, and the user wearing the raincoat of the present invention.
Figure 2:
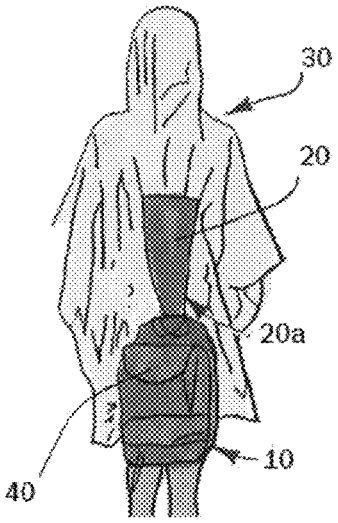
FIG. 2 is a depiction of the present invention that shows how the backpack is permanently attached to the raincoat.

As seen in FIGS. 1-5 the present invention is a backpack with an integral raincoat. The backpack comprises of a bag 10 that has a top 10*a*, a bottom 10*b*, a front 10*c* and rear side 10*d* and a pair of shoulder straps 12 that are attached to the rear side of the backpack 10*d*. The rear side of the backpack 10*d* defines a central opening 14 that defines a first compartment 16 that runs from a top rear side of the backpack 10*e* toward a bottom rear side 10*f* of the backpack 10. A retractable roller mechanism 18 that has a strap 20 attached to the roller mechanism 18 and the roller mechanism is attached to the first compartment 16 of the backpack 10. A raincoat 30 is permanently attached to the strap's end 20*a* not attached to the roller mechanism 18. The bag 10 defines at least one front compartment 40 in the front of the bag 10*c*.

Figure 3:
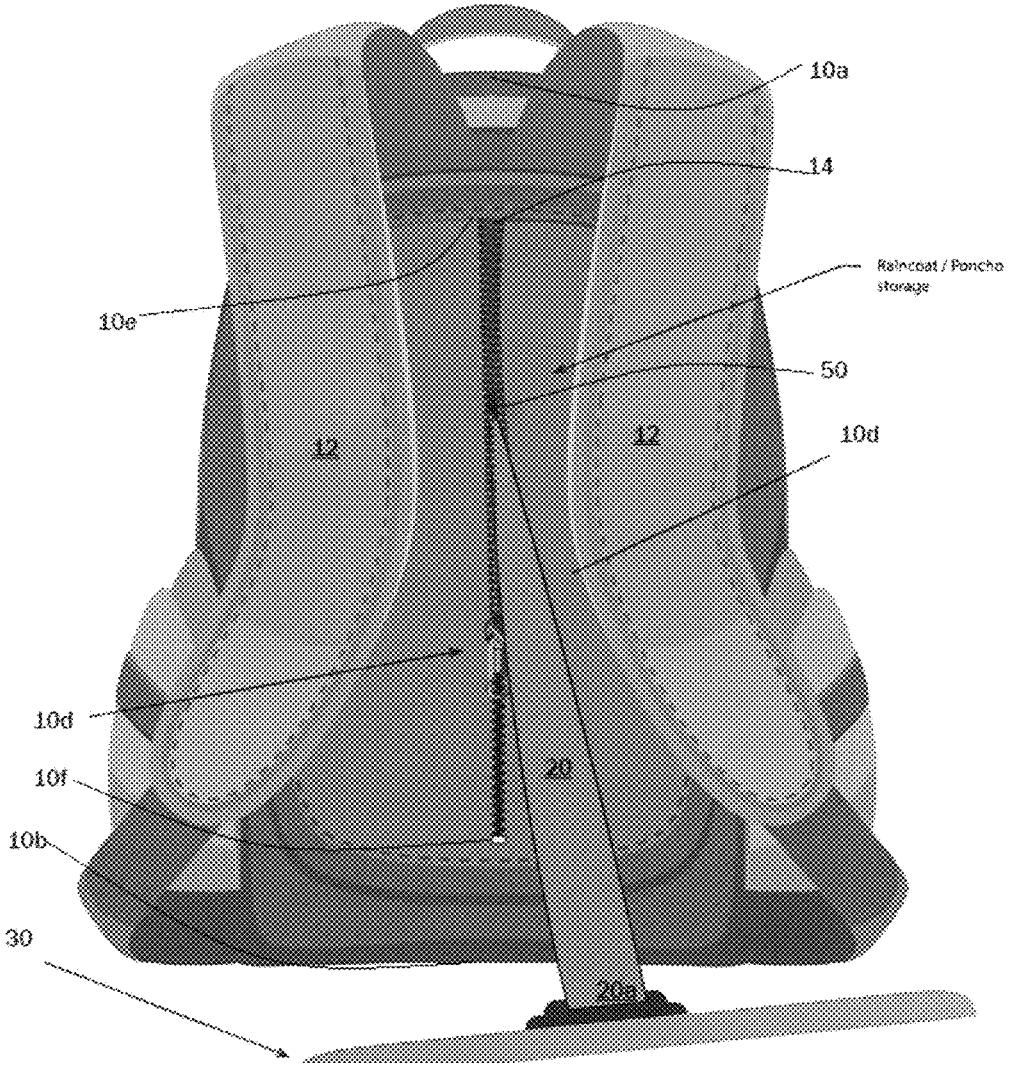
FIG. 3 shows a rear view of the backpack that shows the central opening of the backpack, the strap coming from within the central opening that leads to the raincoat, and a zipper that is used to close the central opening.
Figure 4:
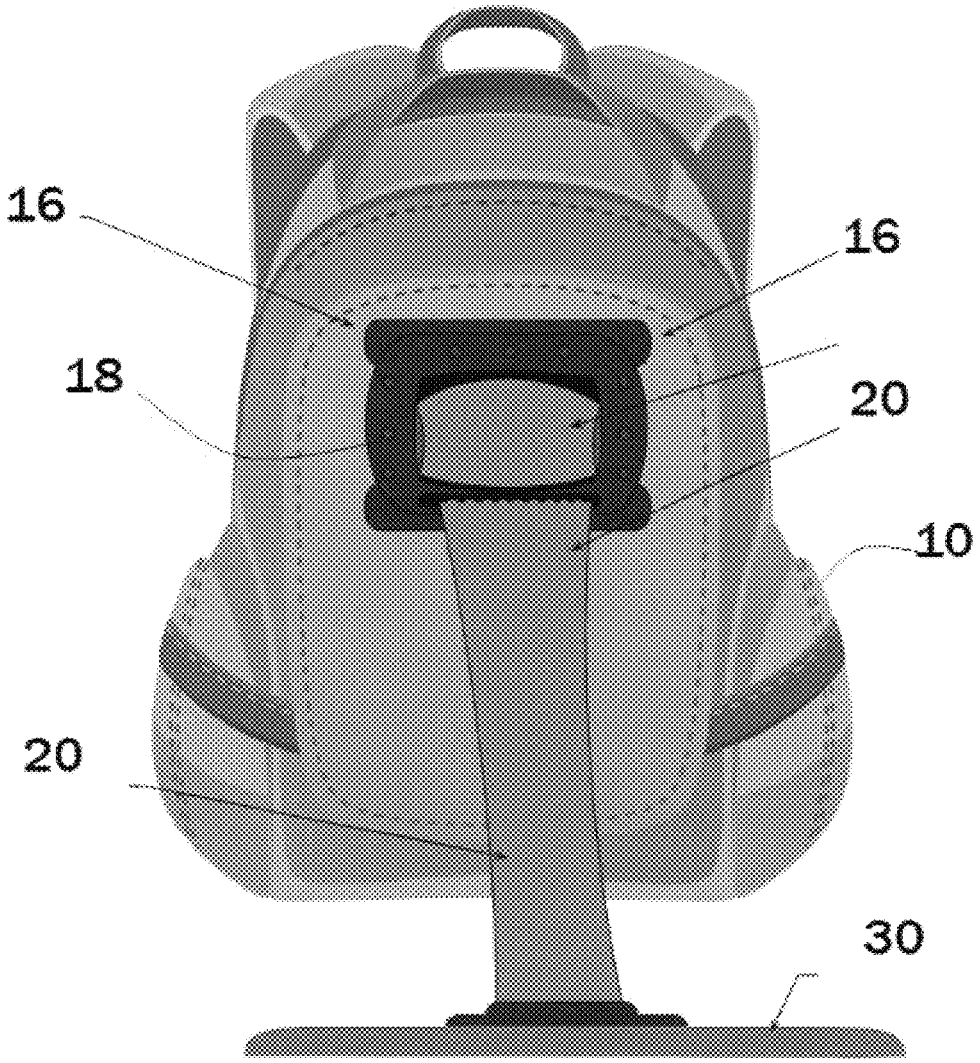
FIG. 4 shows a rear view of the backpack, wherein the cover that cover the central opening is removed to see how the rolling mechanism is permanently attached to the rear of the backpack.

As seen in FIG. 3, a zipper 50 is attached to the central opening of the rear side of the backpack.

Figure 5:
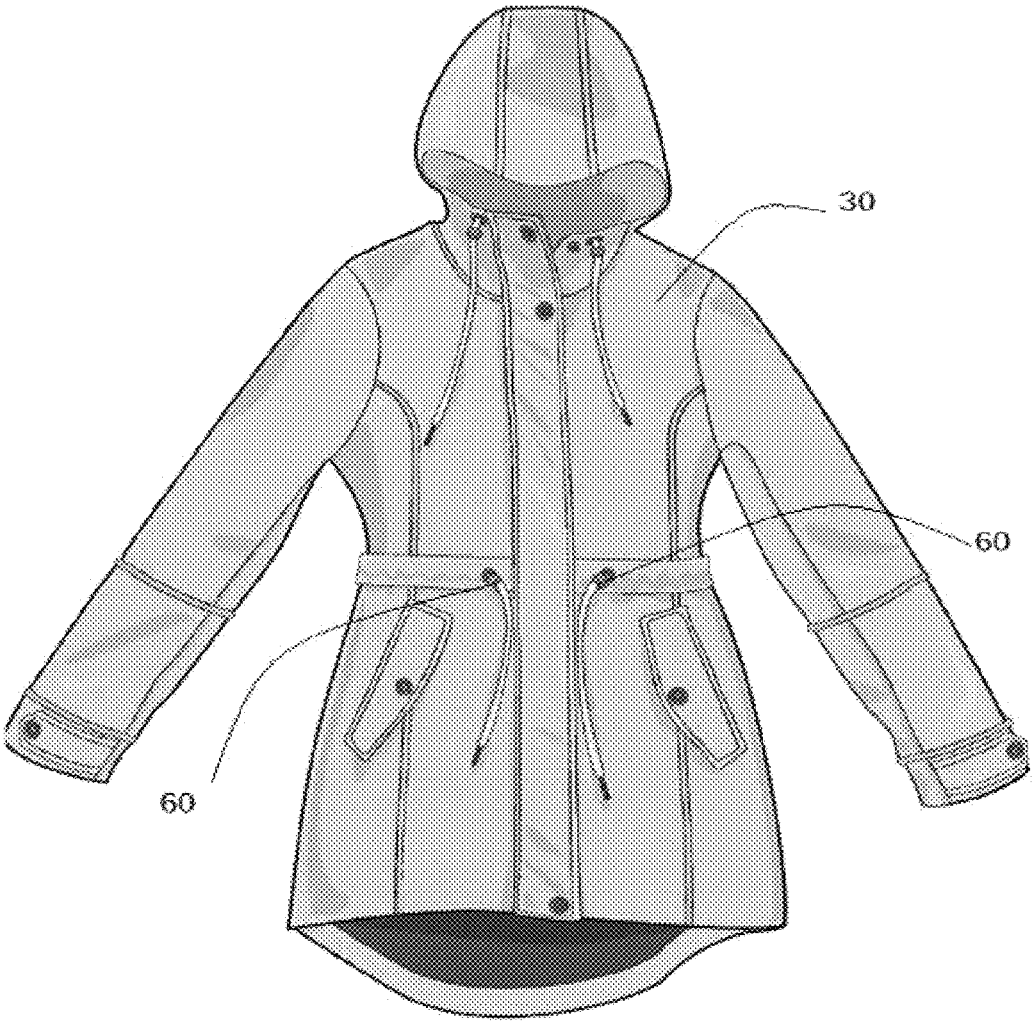
FIG. 5 shows a front view of the raincoat.

As seen in FIG. 5, the raincoat has a waist adjuster 60 integrally sewn to the raincoat 30.

An advantage of the present invention is that it provides a backpack that has an attached retractable raincoat.

Another advantage of the present invention is that it provides a backpack that can be deployed during precipitation and prevents the contents within the backpack from getting wet in precipitation.

While the inventor's above description contains many specificities, these should not be construed as limitations on the scope, but rather as an exemplification of several preferred embodiments thereof. Many other variations are possible. Accordingly, the scope should be determined not by the embodiments illustrated, but by the appended claims and their legal equivalents.

What is claimed is:

1. A backpack with an integral raincoat, the backpack comprises of:

a bag that has a top, a bottom, a front and rear side and a pair of shoulder straps that are attached to the rear side of the backpack, the rear side of the backpack defines a central opening that defines a first compartment that runs from a top rear side of the backpack toward a bottom rear side of the backpack;

a retractable roller mechanism that has a strap, the strap has a first end and a second end, the first end of the strap is attached to the roller mechanism and the roller mechanism is attached to the first compartment of the backpack; and a raincoat that is attached to the second end of the strap, the bag defines at least one front compartment in the front of the bag.

2. The backpack with an integral raincoat of claim 1, wherein the backpack comprises of a zipper that is attached to the central opening of the rear side of the backpack.

3. The backpack with an integral raincoat of claim 1, wherein the raincoat has a waist adjuster integrally sewn into the raincoat.

* * * * *